US006888076B2

(12) United States Patent
Hetherington

(10) Patent No.: US 6,888,076 B2
(45) Date of Patent: May 3, 2005

(54) SUBSTANTIALLY RIGID CAPACITIVE JOYSTICK DESIGNS

(75) Inventor: Jack Hetherington, Haslett, MI (US)

(73) Assignee: P.I. Engineering, Inc., Williamston, MI (US)

( * ) Notice: Subject to any disclaimer, the term of this patent is extended or adjusted under 35 U.S.C. 154(b) by 0 days.

(21) Appl. No.: 10/634,082

(22) Filed: Aug. 4, 2003

(65) Prior Publication Data

US 2004/0099513 A1 May 27, 2004

Related U.S. Application Data

(60) Provisional application No. 60/428,057, filed on Nov. 21, 2002.

(51) Int. Cl.[7] ..... H01H 9/00
(52) U.S. Cl. ..... 200/6 A; 361/290
(58) Field of Search ..... 200/6 A, 6 R, 200/512; 361/290, 292, 299.2, 278, 280, 283.3

(56) References Cited

U.S. PATENT DOCUMENTS

| | | | | |
|---|---|---|---|---|
| 3,270,260 A | | 8/1966 | Mehr | |
| RE29,765 E | | 9/1978 | Crane et al. | 73/432 R |
| 4,493,219 A | | 1/1985 | Sharp et al. | 73/862.05 |
| 4,719,538 A | | 1/1988 | Cox | 361/283 |
| 5,006,952 A | | 4/1991 | Thomas | 361/283 |
| 5,651,044 A | * | 7/1997 | Klotz et al. | 378/117 |
| 5,786,997 A | | 7/1998 | Hoyt et al. | 364/190 |
| 6,115,030 A | | 9/2000 | Berstis et al. | 345/161 |
| 6,184,865 B1 | | 2/2001 | Zimmerman et al. | 345/160 |
| 6,314,823 B1 | | 11/2001 | Okada | 73/862.043 |
| 6,437,772 B1 | * | 8/2002 | Zimmerman et al. | 345/160 |
| 6,642,857 B1 | * | 11/2003 | Schediwy et al. | 341/20 |

* cited by examiner

*Primary Examiner*—R. Lee
(74) *Attorney, Agent, or Firm*—Gifford, Krass, Groh, Sprinkle, Anderson & Citkowski, PC

(57) ABSTRACT

An economical, force-sensing "stiff" capacitive joystick includes a user-manipulable handle coupled to an electrically conductive drive plate, and an electrically conductive surface spaced apart from the drive plate. In the preferred embodiment, one or both of the drive plate and the conductive surface are segmented to produce multiple capacitive sensing elements, such that a force applied to the handle causes a slight deflection of the drive plate, enabling the force to be computed in at least two dimensions through changes detectable in the capacitive sensing elements. One or more electrical controls may be provided on the handle to accommodate different functions. For convenient construction, the electrically conductive drive plate is non-segmented, and the electrically conductive surface forms part of a printed-circuit board having a segmented pattern.

14 Claims, 3 Drawing Sheets

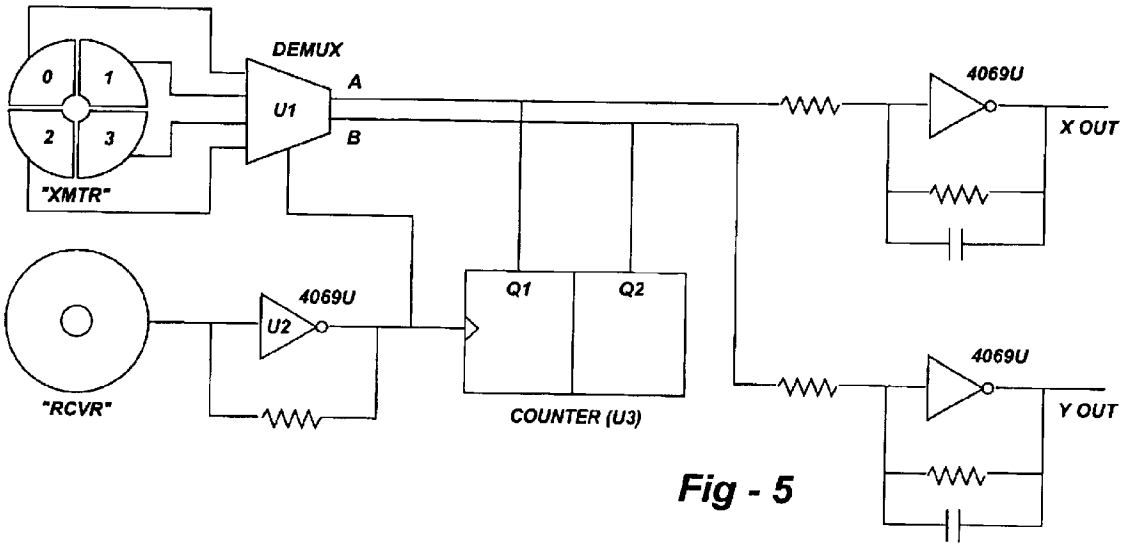
Fig - 5
| B | A | G | 00 | 01 | 10 | 11 |
|---|---|---|---|---|---|---|
| X | X | L | H | H | H | H |
| 0 | 0 | H | L | H | H | H |
| 0 | 1 | H | H | L | H | H |
| 1 | 0 | H | H | H | L | H |
| 1 | 1 | H | H | H | H | L |
Fig - 6
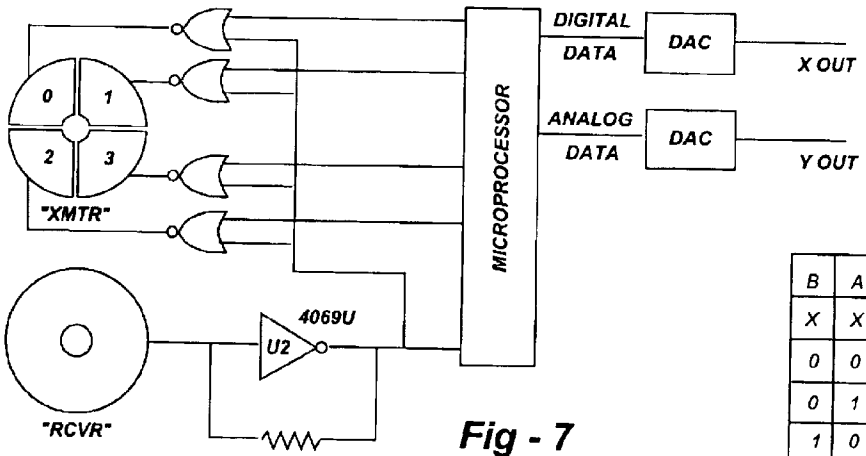
Fig - 7

SUBSTANTIALLY RIGID CAPACITIVE JOYSTICK DESIGNS

REFERENCE TO RELATED APPLICATIONS

This application claims priority from U.S. Provisional Patent Application Ser. No. 60/428,057, filed Nov. 21, 2002, and is incorporated herein in its entirety.

FIELD OF THE INVENTION

The present invention relates generally to joysticks and, in particular, to force-sensitive joysticks.

BACKGROUND OF THE INVENTION

Most joysticks for computer games, and the like, are displacement-responsive in the sense that a hand-operated lever arm is manipulated, and this movement is sensed. However, another class of joysticks are "force-sensitive" insofar as the manually operated input moves imperceptivity, if at all. Such force-sensitive controllers are useful in a variety of applications, including games such as flight simulators, machine tools, cursor controls, vehicle controls, and other devices. In fact, certain ergonomic studies have shown that displacement-responsive joystick controllers give less positive control in some applications, and frequently suffer from excessive backlash as well as lack of tactile feedback in the area around the spring-loaded neutral position.

Based upon such advantages, various force-sensitive joystick designs have been developed for different purposes. As one example of many, U.S. Pat. No. 4,719,538 discloses a capacitive transducer having a plurality of first electrodes which, together with at least one second electrode, define a plurality of variable capacitors having capacitance variable with spacing. An actuator element responsive to externally applied force, and connected to a plate supporting at least one second electrode, angularly deflects the plate and at least one second electrode. This angular deflection, or "tilt," causes the spacing of electrode sets disposed on opposite sides of the center of the plate to vary in a differential manner, thus causing the capacitances of the plurality of capacitors to vary in response to applied moment. Restoring force for the tiltable plate is provided by a flexible diaphragm connected to the plate. A transducer in which the differentially variable sets of capacitances determines the frequencies of a plurality of oscillators, and the differentially varying frequencies of the oscillators are combined to yield difference frequencies representative of the components of applied moment. A microprocessor device processes signals within the transducer and generates signals for controlling an external device.

However, although this design is said to be "force-responsive," the flexible diaphragm results in considerable movement. In addition, the use of a flexible diaphragm may lead to wear and premature fatigue. Based upon the shortcomings of these and other devices, the need remains for an improved force-responsive joystick design that is substantially rigid and economical while offering long-term reliability.

SUMMARY OF THE INVENTION

This invention resides in an economical, force-sensing capacitive joystick responsive to slight operator movements, thus constituting an essentially rigid design. The design broadly includes a user-manipulable handle coupled to an electrically conductive drive plate, and an electrically conductive surface spaced apart from the drive plate.

In the preferred embodiment, one or both of the drive plate and the conductive surface are segmented to produce multiple capacitive sensing elements, such that a force applied to the handle causes a slight deflection of the drive plate, enabling the force to be computed in at least two dimensions through changes detectable in the capacitive sensing elements.

For efficient electrical design, four segments are used and, optionally, one or more electrical controls may be provided on the handle to accommodate different functions. In one embodiment four drive plates are placed on the movable surface and a single receiver plate is on a fixed board with the measuring electronics. For another convenient construction, the electrically conductive drive plate is non-segmented, and the electrically conductive surface forms part of a printed-circuit board having a segmented pattern. As such, no soldered circuit board connections are required.

BRIEF DESCRIPTION OF TEE DRAWINGS

FIG. 5 is a block diagram depicting an electrical circuit for measuring capacitance differences according to the invention;

FIG. 6 is a diagram showing demultiplexer states; and

FIG. 7 depicts an alternate circuit for measurement of the capacitances in the joystick with the potential for digital output and/or analog output.

DETAILED DESCRIPTION OF THE INVENTION

Figure 1:
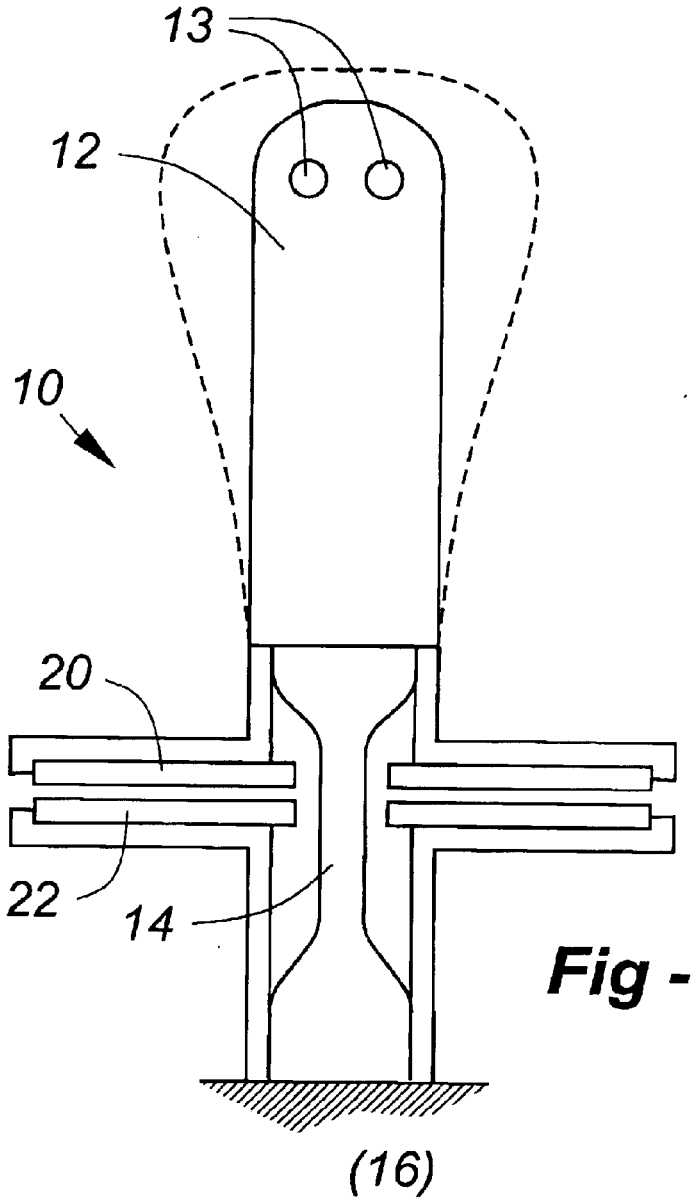
FIG. 1 is a diagram depicting a preferred embodiment of the invention.

This invention resides in a force-sensing capacitive joystick responsive to slight operator movements, thus constituting an essentially rigid design. A preferred embodiment is depicted in FIG. 1, shown generally at 10. The apparatus includes a handle 12 coupled to a force-sensing element (FSE) 14. The FSE 14 is fixed to a base 16. The FSE can be constructed of metal, plastic, or any other suitable material that allows a slight level of deflection in response to a force applied to the handle 12. Note that although considerable force is necessary to deflect the handle, it may be desirable to place mechanical limits on its deflection to prevent damage to the circuit boards or permanent deflection of the FSE.

Although the FSE preferably uses a necked-down portion 15, this may not be necessary depending upon overall geometry and choice of material(s). The shape of the handle may also vary in accordance with user comfort and the intended use, and may include buttons or switches 13, and the FSE may be hollow to accommodate wiring.

Figure 2A:
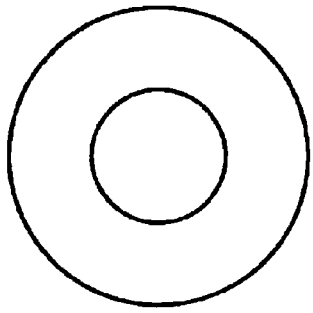
FIGS. 2A shows the construction of a printed-circuit-board plate having a solid conductor pattern.
Figure 2B:
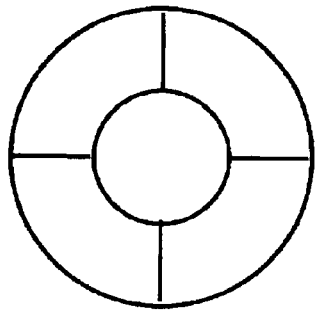
FIGS. 2B shows the construction of a printed-circuit-board plate having a plurality of electrically conductive segments.

An upper electrode plate 20 is attached to the handle portion, and a lower electrode plate 22 is attached to the lower portion of the FSE and/or the base 16. The plates 20, 22 are preferably constructed of printed-circuit boards, with one having a solid conductor pattern and the other having a plurality of electrically conductive segments, as shown respectively in FIGS. 2A and 2B. Although four segments are used to simplify accurate sensing, more or fewer segments may be used with appropriate processing and/or software modifications.

The electrode elements are placed so as to measure small deflections of the handle 12. A change in capacitance of one or more sectors can be used to determine the force applied to the handle. As force is applied to the handle, the FSE bends slightly so that the handle element(s) will approach the base element(s) on one side and move away from those element(s) on the other side. This changes the capacitance and thus provides an electrical or digital measure of the force (and the two components of the force for 2-axis joysticks). The change in capacitance may be measured using any appropriate capacitance measuring technique known to those of skill in the art.

In the example of FIG. 2, four capacitances are measured between the four sectors on one side, and the single sector on the other side. The receiving electrodes A, B, C, and D are connected via C-MOS switch to a measuring circuit (not shown). A change in the capacitance of one or more of the sensors is used to determine the force applied to the handle through the circuit. The X-force is approximately proportional to $C_B+C_C-C_A-C_D$, whereas the Y-force is approximately proportional to $C_A+C_B-C_C-C_D$. A proportionality constant is used in computation, depending upon the spacing the various plates, the size and shape of the plates, and the stress/strain relation of the FSE. Non-linearities may be compensated computationally and/or reduced if the plate separation is kept large compared to the plate displacement.

Figure 4A:
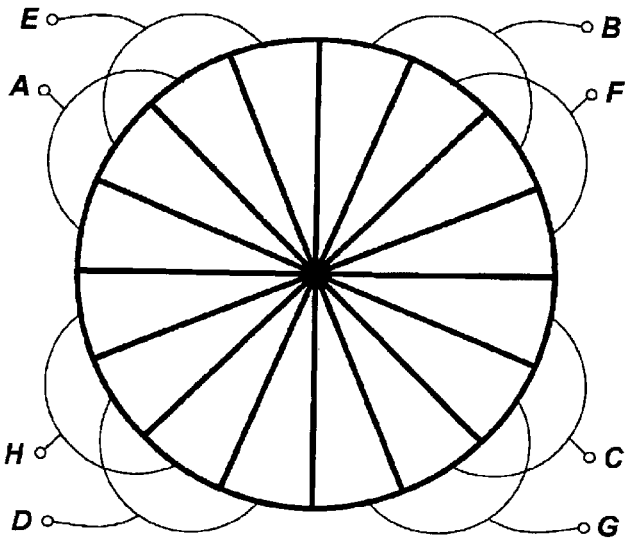
FIG. 4A illustrates how the four segments may be further subdivided into an even number of subsegments wired alternatively together to make a total of eight electrodes.
Figure 4B:
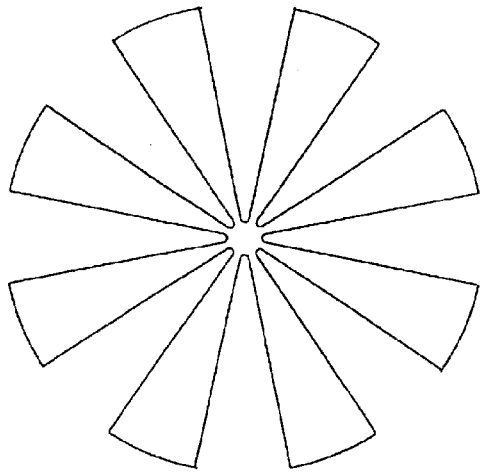
FIG. 4B shows how a single facing electrode may be made with alternately conducting and open segments so that each segment at least straddles two segments.

As a further refinement, torque may be measured through appropriate modification to the segments. For example, the FSE may contain sleeved upper and lower portions allowing for twisting while retaining substantial rigidity is response to deflection. One potential modification to the segments is shown in FIG. 4. In this case, the four segments are further subdivided into an even number of subsegments wired alternatively together to make a total of eight electrodes, as shown in FIG. 4A. The single facing electrode is made with alternately conducting and open segments so that each segment at least straddles two segments, preferably matching the angular width of the above subsegments and offset by ½ their width, as shown in FIG. 4B. With particular reference to FIG. 4A, the values of X, Y and θ are obtained by the capacitance combinations:

$$X\sim(B+F+C+G-(A+E+H+D);$$

$$Y\sim(A+E+B+F)-(H+D+C+G);\text{ and}$$

$$\theta\sim(A+B+C+D)-(E+F+G+H),$$

wherein the force-measuring element measures torque by its coefficient of angular deflection relative to torque.

Figure 3:
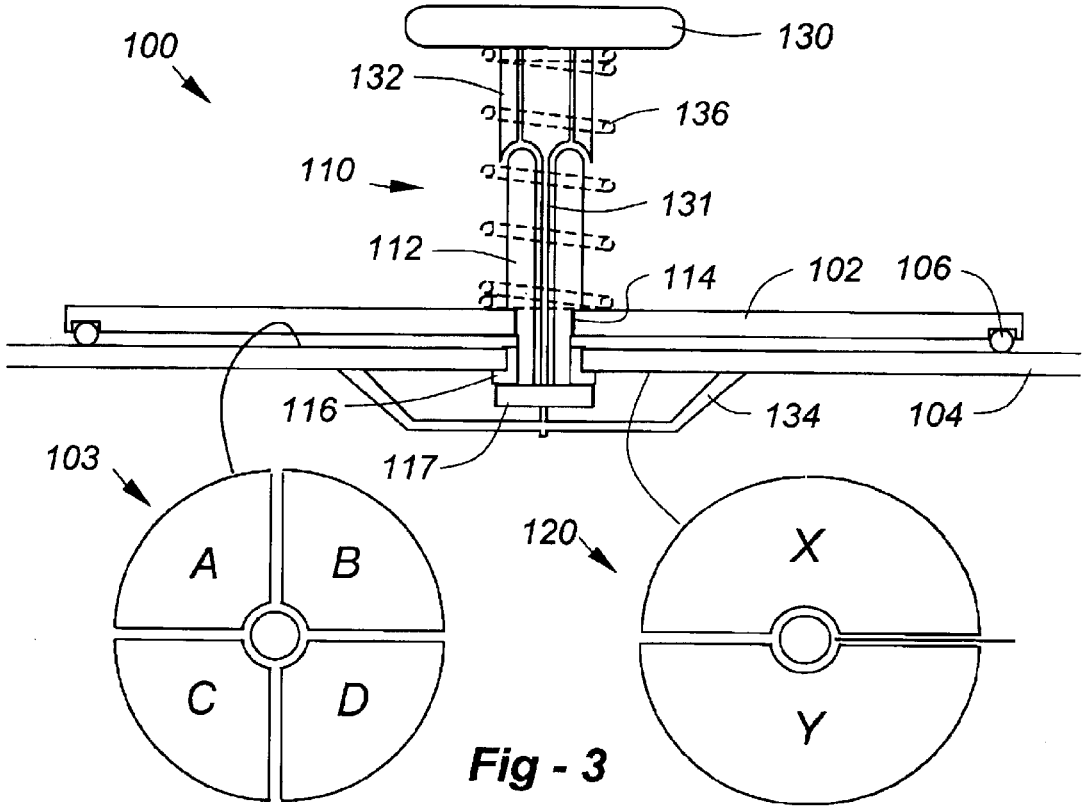
FIG. 3 depicts a more robust and potentially smaller embodiment including a handle with a button mechanically coupled to an electrical switch.

FIG. 3 depicts a more robust and potentially smaller embodiment including a handle with a button 130 mechanically coupled to an electrical switch. Compression of the button 130 causes a rod 131 journaled within a hollow stem 116 to lift an electrically conductive spider 134 from the back side of the circuit board 104. The back side of the circuit board 104 includes a pattern 120 including, for example, electrically conductive areas X and Y which are shorted when the button is not compressed, but when the button is compressed, the electrical connection between the two halves of the switched electrodes is broken, which can then be sensed. Flexible portions 132 may be provided to generate an audible or tactile "click" as the button 130 is pressed down.

To sense deflection, the handle portion 110 is rigidly coupled to a conductive drive plate 102 above a circuit board 104. The drive plate 102 is generally held in a parallel, spaced-apart relation to the circuit board 104 through a conductive washer/spacer 116 held in place by a nut or other type of fastener 117. An elastic O-ring or other appropriate compressible material keeps the drive plate 102 spaced apart from the upper surface of the circuit board 104 while, at the same time, allows minor angular deflections, with the member 106 providing a restorative force.

The upper surface of the circuit board 104 includes a pattern 103, in this case with conductive segments A, B, C and D, such that as the conductive drive plate 102 moves relative to the pattern 103, changes in capacitance may be detected which, in turn, converted to force-sensing signals, as discussed in relation to FIGS. 1 and 2.

Connection to the drive plate 102 is made through the bottom of the circuit board 104 through conductive path 118. The path 118, in turn, makes electrical contact to a conductive washer/spacer 116 which, in turn, is in electrical communication with a hollow conductive stem 112 coupled with drive plate 102 at 114. Since the electrical connections to both the sensing plates and the switch are made through circuit board patterns, no soldered connections are required. Alternatively, the connection to plate 102 may be made by a trace introduced between the segments on the top of the board to simplify the contract of the conductive spider with the areas X,Y on the bottom.

FIG. 5 is a block diagram depicting an electrical circuit for measuring capacitance differences according to the invention. The "RCVR" plate 502 overlaps the transmitter sectors 504 so that a capacitance $C_{AB}$ is established between the AB sector and the "RCVR" plate 502. With definite logic values for A, B the circuit oscillates with a period $T_{AB}$ proportional to the capacitance $C_{AB}$. By setting A, B as the outputs of two bits of a counter the fraction of the time spent in the upper sectors is $(T_{11}+T_{00})/(T_{00}+T_{01}+T_{10}+T_{11})$ and the fraction in the lower is $(T_{11}+T_{00})/(T_{00}+T_{01}+T_{10}+T_{11})$ thus the average voltage on wire B is $$\frac{V_0}{2}\left[1+(T_{11}+T_{10}-T_{01}-T_{00})/(T_{00}+T_{01}+T_{10}+T_{11})\right]=\frac{V_0}{2}\left[1+\left(\frac{C_{11}+C_{10}-C_{01}-C_{00}}{C_{11}+C_{10}+C_{01}+C_{00}}\right)\right]$$

where $V_0$ is the logic high voltage, and is thus a measure of the Y displacement of the joystick. Similarly the average voltage on A is a measure of the X displacement. These voltages are averaged and amplified by the integrating circuits with an averaging time constant $C_1R_2$ and a gain.

$$\frac{R_2}{R_1}.$$

The oscillator circuit has the advantage that frequency is almost entirely dependent on $C_{AB}$ and $R_F$, with stray capacitances to ground and in the input to the inverter contributes mainly to noise, which is small in our application.

The functionally of U1 is provided by a 74HC138, U2 a 4069U (CMOS logic) and U3 by a 74HC74 or a 74HC404.

For the circuit to work as shown the demux U1 has the selected output low with G high according to the scheme shown in FIG. 6. The operation of the circuit is as follows. Assume that the RCVR voltage is less than $$\frac{V_0}{2}$$

so that the inverter output is high, the charge on the RCVR will increase as current bleeds through $R_F$. When $V_{RCVR}$ passes $$\frac{V_0}{2}$$

the voltage on the gate G goes to 0 (low) and the selected plate goes high and through, the capacitance $C_{AB}$, further raises the voltage on RCVR. However, now the charge is draining from RCVR through $R_F$ causing a return to the original state. Typically this circuit oscillates in the 100 KHz–1 MHz range, and the output signals can be filtered easily by the integrators/low pass filters with time constant in milliseconds. To better balance the output when the stick is in neutral it is sometimes useful to add biasing resistors to the inputs of the two output inverters in FIG. 5. In addition, further filtering may be desirable, which may be achieved by adding simple RC low-pass filters on the outputs.

FIG. 7 depicts an alternate circuit for measurement of the capacitances in the joystick with the potential for digital output and/or analog output. Here the oscillator section works similarly to the above discussion but the control of sector selection is given to the microprocessor. The period of oscillation for each sector is measured by the microprocessor (by virtue of an internal prescaler) and the quantities. $(C_{00}+C_{01}-C_{10}-C_{11})/(C_{00}+C_{01}+C_{10}+C_{11})$, etc., are computed digitally and output by a digital protocol either to the equipment off the board or to a digital to analog converter (or digital potentiometer).

I claim:

1. A substantially rigid, force-sensing joystick, comprising:

a user-manipulable handle coupled to an electrically conductive drive plate;

an electrically conductive surface spaced apart from the drive plate, wherein one or both of the drive plate and the conductive surface are segmented to produce multiple capacitive sensing elements, such that a force applied to the handle causes a slight deflection of the drive plate, enabling the force to be computed in at least two dimensions through changes detectable in the capacitive sensing elements; and one or more electrical controls on the handle.

2. The rigid, force-sensing joystick of claim 1, including four segments.

3. The rigid, force-sensing joystick of claim 1, wherein the electrically conductive drive plate is non-segmented, and the electrically conductive surface forms part of a printed-circuit board having a segmented pattern.

4. The rigid, force sensing joystick of claim 3, requiring no soldered connections to the circuit board.

5. A substantially rigid, force-sensing joystick, consisting essentially of:

a user-manipulable handle coupled to an electrically conductive drive plate; and an electrically conductive surface spaced apart from the drive plate, wherein one or both of the drive plate and the conductive surface are segmented to produce multiple capacitive sensing elements, such that a force applied to the handle causes a slight deflection of the drive plate, enabling the force to be computed in at least two dimensions through changes detectable in the capacitive sensing elements.

6. The rigid, force-sensing joystick of claim 5, including four segments.

7. The rigid, force-sensing joystick of claim 5, further including one or more electrical controls on the handle.

8. The rigid, force-sensing joystick of claim 5, wherein the electrically conductive drive plate is non-segmented, and the electrically conductive surface forms part of a printed-circuit board having a segmented pattern.

9. A substantially rigid, force-sensing joystick, comprising:

a user-manipulable handle coupled to a base plate through a substantially rigid force-sensing element that allows only a slight deflection of the handle in response to an applied force;

an electrically conductive drive plate physically coupled to the handle; and an electrically conductive surface physically coupled to the base plate and spaced apart from the drive plate, wherein one or both of the drive plate and the conductive surface are segmented to produce multiple capacitive sensing elements without the need for any additional electrodes, such that a force applied to the handle causes a slight deflection of the drive plate, enabling the force to be computed in at least two dimensions through changes detectable in the capacitive sensing elements.

10. The rigid, force-sensing joystick of claim 9, including four segments.

11. The rigid, force-sensing joystick of claim 9, further including one or more electrical controls on the handle.

12. The rigid, force-sensing joystick of claim 9, wherein the force-sensing element is composed of metal.

13. The rigid, force-sensing joystick of claim 9, wherein the force-sensing element is composed of plastic.

14. The rigid, force-sensing joystick of claim 9, wherein the force-sensing element is necked-down.

* * * * *